United States Patent [19]

Grosch

[11] 4,070,832

[45] Jan. 31, 1978

[54] CONCRETE WELL CASING WITH CABLE HOOKS EMBEDDED THEREIN

[76] Inventor: Gottlieb W. Grosch, Silver Creek, Nebr. 68663

[21] Appl. No.: 730,391

[22] Filed: Oct. 26, 1976

[51] Int. Cl.[2] ..... E04D 15/00

[52] U.S. Cl. ..... 52/125

[58] Field of Search ..... 52/125, 127, 169.6, 52/169.7, 21, 245, 600, 124, 351, 122

[56] References Cited

U.S. PATENT DOCUMENTS

| | | | |
|---|---|---|---|
| 1,447,421 | 3/1923 | Kircher | 52/245 X |
| 1,656,571 | 1/1928 | Sarber | 52/124 |
| 3,187,694 | 6/1965 | Crookston et al. | 52/125 X |

*Primary Examiner*—Ernest R. Purser
*Assistant Examiner*—Carl D. Friedman
*Attorney, Agent, or Firm*—Zarley, McKee, Thomte, Voorhees & Sease

[57] ABSTRACT

A concrete well casing comprising a cylindrical reinforcing mesh wire having inner and outer sides and upper and lower ends. The wire mesh is comprised of a plurality of substantially horizontally disposed and vertically spaced-apart ring-shaped members which are operatively interconnected by vertical rods secured thereto. A plurality of cable hooks are operatively secured to the wire mesh and extend outwardly therefrom. The wire mesh is embedded in concrete to form the casing. Each of the cable hooks has an arcuate outer end portion which is normally substantially flush with the exterior surface of the casing but which may be deflected outwardly therefrom for attachment to a casing positioning cable.

3 Claims, 9 Drawing Figures

CONCRETE WELL CASING WITH CABLE HOOKS EMBEDDED THEREIN

BACKGROUND OF THE INVENTION

This invention relates to a concrete well casing and more particularly to a concrete well casing having means secured thereto for lowering the same into a well.

Concrete well casing is ordinarily positioned in a well to prevent the walls of the well from collapsing. The concrete well casings normally are comprised of a cylindrical wire mesh which is embedded in perforated concrete.

The customary manner of positioning the casing members in a well is to extend a pair of cables upwardly through a pair of casing members arranged in an end-to-end relationship. After the two lowermost well casing members are positioned in the bottom of the well, additional casing members are lowered downwardly into the well on cables so that the casing members will be properly positioned. It has been found that the need for extending cable members through the concrete casing members themselves is expensive, time-consuming and frequently meets with serious problems. Many times wells have had to be abandoned due to the difficulty in positioning the casing members in the well.

Therefore, it is a principal object of the invention to provide an improved concrete well casing.

A further object of the invention is to provide a concrete well casing having cable hooks provided thereon.

A still further object of the invention is to provide a concrete well casing having a plurality of cable hooks secured to the reinforcing wire mesh.

A still further object of the invention is to provide a concrete well casing having cable hooks secured thereto wherein the outer ends of the cable hooks are normally flush with the exterior surface of the casing but which may be deflected outwardly therefrom.

A still further object of the invention is to provide a concrete well casing including cable hooks wherein the cable hooks do not interfere with the manufacture of the well casing.

A still further object of the invention is to provide a concrete well casing which is economical to manufacture, durable in use and refined in appearance.

DESCRIPTION OF THE PREFERRED EMBODIMENT

Figure 1:
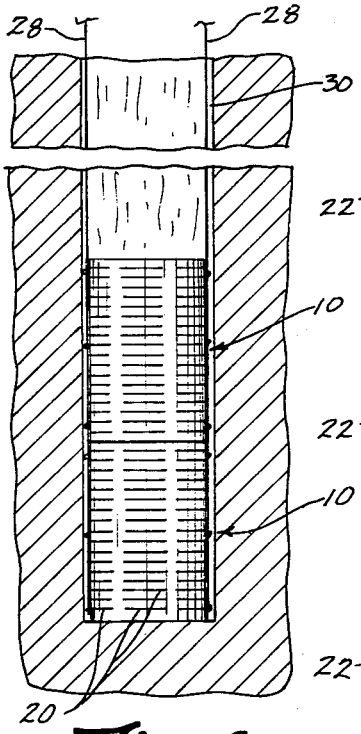
FIG. 1 is a partial sectional view illustrating the concrete well casing of this invention positioned in a well.
Figure 2:
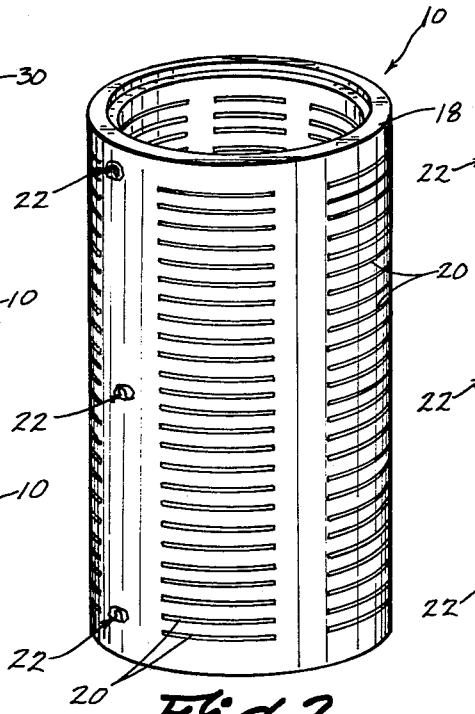
FIG. 2 is a perspective view of the casing.
Figure 3:
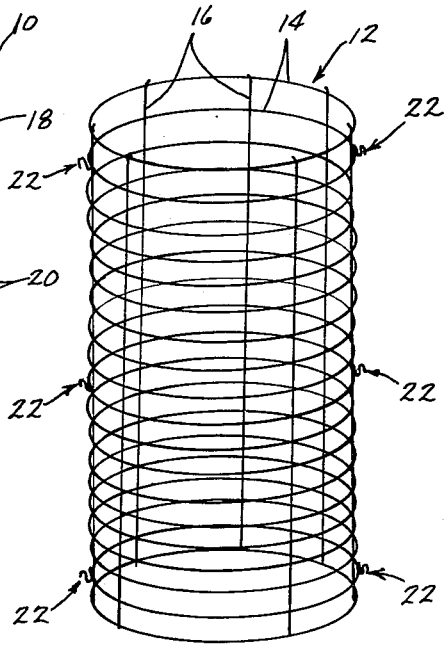
FIG. 3 is a perspective view of the reinforcing wire and hooks secured thereto prior to the concrete being placed thereon.
Figure 4:
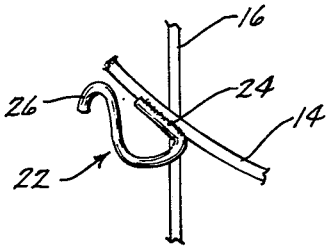
FIG. 4 is a perspective view of one of the hooks.

The concrete well casing of this invention is referred to generally by the reference numeral 10. Casing 10 includes a cylindrical wire mesh or reinforcing wire 12 which is comprised of a plurality of horizontally disposed and vertically spaced ring-shaped members 14 operatively interconnected by a plurality of vertically extending rods 16 secured thereto by welding or the like. Ordinarily, the wire mesh 12 is embedded in a layer of concrete in conventional fashion and which is referred to generally by the reference numeral 18. Concrete 18 is provided with a plurality of perforations 20 formed thereon which permits the water in the water bearing sand to enter the interior of the casing members when the same are positioned within the well.

Figure 5:
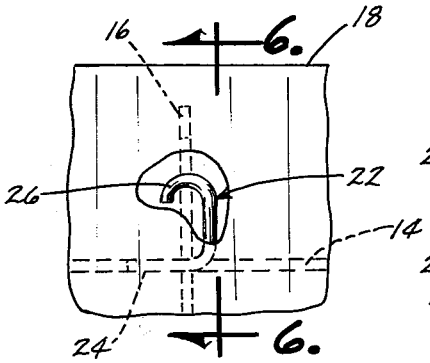
FIG. 5 is a partial side view of the casing.
Figure 6:
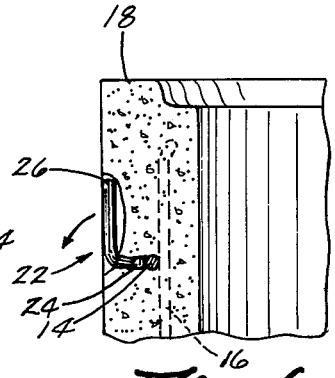
FIG. 6 is a sectional view seen on lines 6—6 of FIG. 5.
Figure 7:
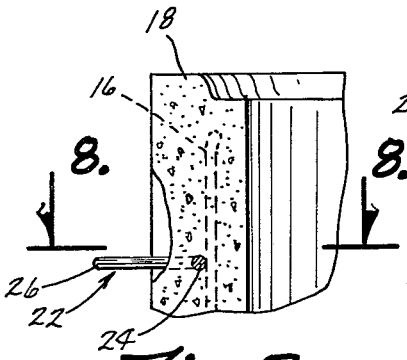
FIG. 7 is a view similar to FIG. 6 except that the hook has been bent outwardly from the position of FIG. 6.
Figure 8:
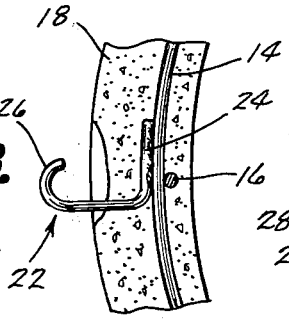
FIG. 8 is a sectional view seen on lines 8—8 of FIG. 7.
Figure 9:
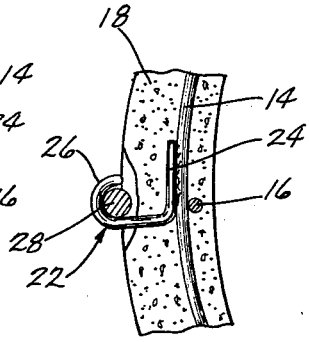
FIG. 9 is a view similar to FIG. 9 except that the hook has been bent into engagement with the cable.

The numeral 22 refers to cable hooks which are secured to the wire mesh as will be described in more detail hereinafter. Any number of cable hooks may be employed but it is recommended that at least three vertically spaced cable hooks be provided at each side of the casing member. Each of the hooks 22 comprises a base portion 24 which is secured to one of the ring-shaped members 14 by welding. Hook 22 also comprises an arcuate portion 26 which extends outwardly from base portion 24 as seen in the drawings, base portion 24 is elongated and has the arcuate portion 26 extending outwardly from one end thereof. Arcuate portion 26 comprises a first portion 26A and an open-sided C-shaped hook portion 26B which defines a cable receiving area 26C. Arcuate portion 26 is formed so that it is normally flush with the exterior surface of the casing 10 as illustrated in FIGS. 5 and 6. Thus, the hooks 22 do not interfere with the normal manufacture or fabrication of the casing 10. The hooks 22 are not disturbed until the casing members are ready to be lowered into the well. At such time, the arcuate portions 26 of the hooks 22 are bent or deflected, with a screwdriver or the like, outwardly from the exterior surface of the casing so as to be exposed as illustrated in FIGS. 7 and 8. Cable 28 is then positioned within the arcuate portion 26 of the hook 22 and the arcuate portion 26 is closed on the cable by means of a hammer or the like so that the hook 22 securely receives the cable.

A pair of cables 28 are secured to the cable hooks 22 at each side of a pair of casings 10 as seen in FIG. 1. The two casings are aligned in an end-to-end relationship and are lowered downwardly into the well 30. When the two lowermost casing members are properly positioned, additional casing members are lowered downwardly into the well between the cables 28. The spaced cables 28 maintain the casing members in the proper position as the casings are being lowered into the well.

Thus it can be seen that a novel concrete well casing has been provided which includes means for attaching positioning cables thereto. The cable hooks are an integral part of the casing members since they are welded to the reinforcing wire which is embedded in the concrete. The configuration of the cable hooks is such that the hooks do not interfere with the fabrication or manufacture of the casing but are easily deflected outwardly therefrom for attachment to the positioning cables. Thus it can be seen that the invention accomplishes at least all of its stated objectives.

I claim:

1. A concrete well casing, comprising, a cylindrical reinforcing wire means having inner and outer sides and upper and lower ends, said reinforcing wire means being comprised of a plurality of substantially horizontally disposed and vertically spaced-apart ring-shaped members operatively interconnected, at least one cable hook operatively secured to said wire means at each side thereof and extending outwardly therefrom, said wire means being embedded in concrete to form the casing, each of said cable hooks comprising a base portion and an arcuate free end portion extending outwardly therefrom, said base portion being operatively secured to said wire means, said arcuate portion terminating in an open-sided C-shaped hook portion defining a cable receiving area, said C-shaped hook portion being initially substantially flush with the exterior surface of said casing but which may be deflected outwardly therefrom for receiving a casing positioning cable in said cable receiving area for attachment thereto.

2. The casing of claim 1 wherein said base portion is welded to said wire means.

3. The casing of claim 1 wherein a plurality of vertically spaced hooks are secured to opposite sides of said wire means.

* * * * *